United States Patent [19]

Miklos

[11] 4,086,667

[45] May 2, 1978

[54] FLUSH CONTROL DEVICE FOR CONSERVING WATER

[76] Inventor: Louis F. Miklos, 6151 Delaware St., Merrillville, Ind. 46410

[21] Appl. No.: 673,005

[22] Filed: Apr. 2, 1976

Related U.S. Application Data

[63] Continuation-in-part of Ser. No. 604,346, Aug. 13, 1975, abandoned.

[51] Int. Cl.[2] ..... E03D 1/34

[52] U.S. Cl. ..... 4/325

[58] Field of Search ..... 4/34, 37, 52, 53, 56, 4/67 R, 67 A, DIG. 1, 57 R, 57 P

[56] References Cited

U.S. PATENT DOCUMENTS

| | | | |
|---|---|---|---|
| 2,950,483 | 8/1960 | Richards | 4/67 A |
| 3,149,345 | 9/1964 | Harris | 4/67 R X |
| 3,156,930 | 11/1964 | Moulton et al. | 4/53 X |
| 3,421,161 | 1/1969 | Stafford et al. | 4/67 R |
| 3,777,316 | 12/1973 | Coetzee | 4/67 A X |
| 3,787,902 | 1/1974 | McCombs | 4/67 A |
| 3,823,425 | 7/1974 | Coffman | 4/53 |
| 3,885,253 | 5/1975 | Overbey | 4/37 X |
| 3,981,029 | 9/1976 | Johnson | 4/37 X |

*Primary Examiner*—Richard E. Aegerter
*Assistant Examiner*—Stuart S. Levy
*Attorney, Agent, or Firm*—Walter Leuca

[57] ABSTRACT

This invention relates to flush tank type toilets and is a device by which a long or short flush cycle may be selected by manipulation of the flush lever handle. The conventional flush uses the full contents of the flush tank and is selected when solid waste must be flushed through the toilet. The short flush uses a portion of the flush tank contents and is selected to conserve water when liquid waste is flushed. This device controls the lifting of the outlet stopper by providing float operated cam member (or members) acting on a rod link connected to the flush lever which lifts the stopper, holding the lever and stopper in the lifted position. When the water level in the tank drops below the float, the cam releases the rod link and the stopper will be force-seated into the discharge outlet of the tank by the water remaining in the tank.

24 Claims, 15 Drawing Figures

FLUSH CONTROL DEVICE FOR CONSERVING WATER

BACKGROUND OF THE INVENTION

This application is a continuation-in-part of my earlier co-pending application Ser. No. 604,346 filed on Aug. 13, 1975, now abandoned.

FIELD OF THE INVENTION

This invention relates generally to flush control mechanisms used in flush tank type toilets and more particularly, to a device for attachment to a conventional flush tank to allow manual selection of water volume used in a flush cycle.

DESCRIPTION OF THE PRIOR ART

In flush tank toilets a reservoir of water is retained in the flush tank. To flush the toilet the user pivots a handle on the flush tank which moves a lever connected to the handle. The end of the lever is mechanically linked to a ball stopper which is seated in the flush tank discharge outlet. Operating the flush handle pivots the lever upward, lifting the stopper ball from the discharge outlet. In a normal flush cycle the ball stopper is lifted far enough to remain buoyed on the water. The water in the flush tank then escapes out the discharge outlet through a number of orifices in the toilet bowl and the bowl contents are flushed into the sewage disposal system. When the water level in the flush tank drops low enough, the stopper ball falls and seats in the discharge outlet. The flush tank refills and is ready for the next flush cycle.

Allowing the ball stopper to buoy upward allows the flush cycle to proceed to completion even though the flush lever has been allowed to drop to its resetting position. A primary disadvantage of this system is that the entire content of the flush tank is used in every flush cycle whether or not the full amount of water is needed to provide adequate flushing of the toilet bowl contents.

SUMMARY OF THE INVENTION

The short flush device of this invention comprises a support member adapted to be mounted inside the flush tank. A rod engages the ball stopper lever and is vertically movable in a guide assembly supported on the support member. A float-operated cam is pivotally connected to the guide assembly and serves to act against the rod when lifted thereby preventing further upward movement of the lever and ball stopper. When the flush lever is pivoted, the ball stopper is lifted from the discharge outlet but not far enough to allow the stopper to buoy upward. The lever also lifts the rod member until positive stop means on the rod and guide assembly such as, for example, a notch in the rod is aligned with a matching detent on the guide assembly. Pressure from the float-operated cam forces the notch in the rod member to engage the detent, locking the rod in place and hence the flush lever and stopper in the limited raised position. After the flush tank water level has dropped below the cam float, force is no longer maintained on the rod by the cam. The notch disengages from the detent freeing the rod, allowing the flush lever to drop to its resting position and allowing the stopper to seat in the flush tank discharge outlet stopping the flushing operation. Means are provided to allow engagement and disengagement of the device of my invention. I provide a spring biased flush handle whereby the lever connected thereto may be displaced laterally. The flush lever is linked to the ball stopper in the conventional manner and due to the spring bias, normally engages a horizontally extending slot in the rod member. When a long flush is activated, pushing inward on the flush handle displaces the flush lever laterally and disengages it from a slot in the rod member. Then, when the flush handle is rotated, the flush lever moves upward and the flush cycle proceeds to completion in the conventional manner. When a short flush is desired, the flush handle is rotated without pushing it inward toward the tank wall. The flush lever remains engaged in the slot of the rod member. The amount of water discharged in the short flush is determined by the position of the flush control float on the arm that attaches to the cam. The higher the flush control float is positioned, the shorter the flush cycle.

It is, therefore, the primary object of my invention to provide a flush control device for conserving water which can be easily installed on existing tank type toilets.

Another object of my invention is to provide a flush control device for conserving water that is adjustable in the amount of water discharged in the short or long flush cycle.

Still another object of my invention is to provide a flush control device for conserving water which is operable with a non-floatable outlet stopper.

Other objects and advantages of this invention will become apparent by a careful study of the following detailed description when read with reference to the accompanying drawings which illustrate the preferred embodiment of this invention.

DESCRIPTION OF THE PREFERRED EMBODIMENT

Figure 1:
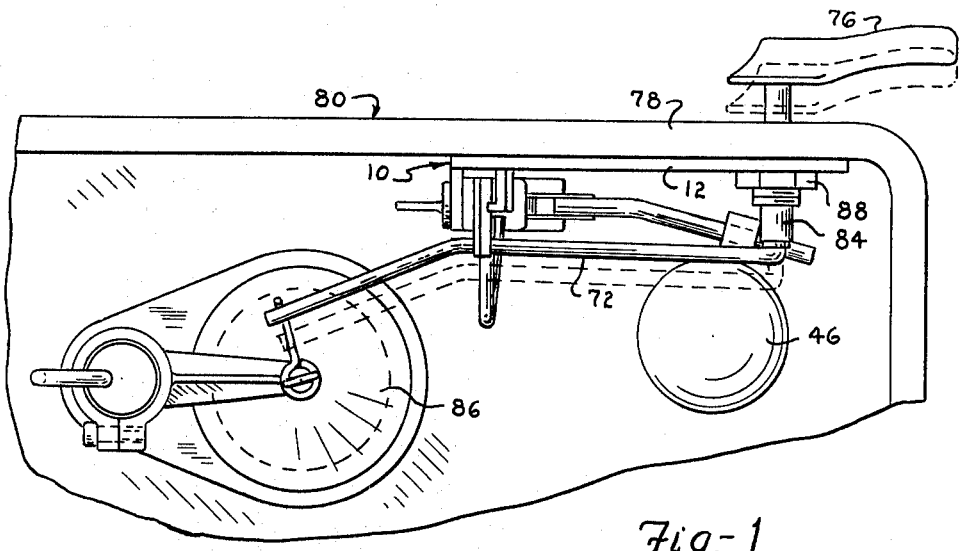
FIG. 1 is a top view of the flush control device of my invention connected to the toilet flush tank which is shown in fragment.

Referring now to the drawings particularly FIGS. 1 through 5, the flush control device of my invention is designated generally by the numeral 10. It comprises a support member 12 formed with a horizontally extending arm 14 and a vertically extending leg 16 depending therefrom. Leg 16 is provided with flange 18. Flange 18 is formed with a slotted aperture 20 and further provided with a T shaped lug 22. Arm 14 is formed with a hole 24 and provided with wedge block 26. Supported on support member 12 against flange 18 is rod guide assembly 28. Rod guide assembly 28 is preferably formed with back plate 30 having at the top thereof rod guide bracket 32 and a second rod guide bracket 34 spaced below bracket 32. Bracket 34 is formed with pivot lug 36 and connected to back plate 30 with stiffeners 37. Though it is not necessary to provide means for a positive stop because the rod may be supported in its elevated position solely by friction between the members if the side force exerted by the float-operated cam is great enough, detent or projection 38, as an example of a positive stop means, may be provided on back plate 30. Back plate 30 is further provided at the bottom thereof with slot 40. Back plate 30 and guide bracket 32 are provided with a threaded hole 42 for receiving therethrough thumb screw 44 by which means rod guide assembly 28 is connected against flange 18 of support member 12. In providing slot 20 in flange 18 through which thumb screw 44 passes for tightening in threaded hole 42, guide assembly 28 may be vertically adjusted on flange 18. T shaped lug 22 engages back plate member 30 through slot 40 therein whereby the bottom end of back plate 30 straddles the anchor stem of T lug 20 and is retained thereby when secured thereto by thumb screw 44 and allows easy removal therefrom, when desired.

Float 46 is connected to the distal end of float arm 48 by any convenient means such as screw block 50 provided with thumb screw 52 whereby float 46 may be radially and longitudinally positioned on arm 48 to control the level at which the flush device of my invention will cycle. The other end of arm 48 is provided with pivot yoke 54 having cam roll 56 at the end thereof. Float arm 48 is pivotally connected to pivot lug 36 on guide bracket 34.

Elongated rod member 58 is freely movable in guide brackets 32 and 34. I form rod member 58 with slotted aperture 60 and spaced therebelow I provide, if positive stop means is desired, a notch 62 in the side of rod member 58 facing back plate 30 for engagement with detent 38 thereon during the operation of my invention. The portion of rod 58 containing slotted aperture 60 is movable within guide bracket 32 and receives the extended shaft 64 of thumb screw 44 to limit the vertical movement of rod 58 within the longitudinal limits of slot aperture 60. Extending from the top of rod 58 is a resiliently flexible sheet member 66 which is formed with a horizontally extending slot 68, one side thereof as at 70 extends horizontally to provide a base against which the conventional ball stopper lever 72 rests. The upper edge of horizontal slot 68 terminates as at 74 and that part of member 66 extends upright to prevent lever 72 from accidentally pivoting over flexible member 66 thereby preventing lever 72 from returning to its support edge 70.

Figure 3:
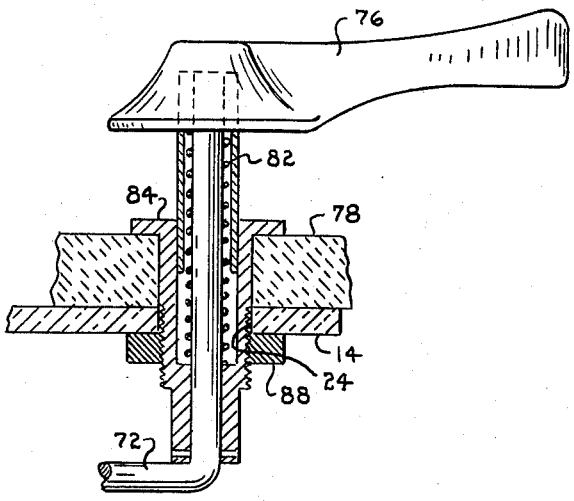
FIG. 3 is a top view of the flush handle and bushing assembly shown in cross section along lines 3—3 of FIG. 2.
Figure 4:
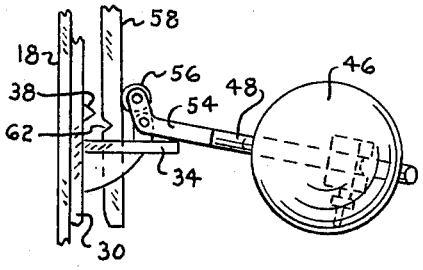
FIG. 4 is a detailed view of the float-operated cam of this invention.
Figure 5:
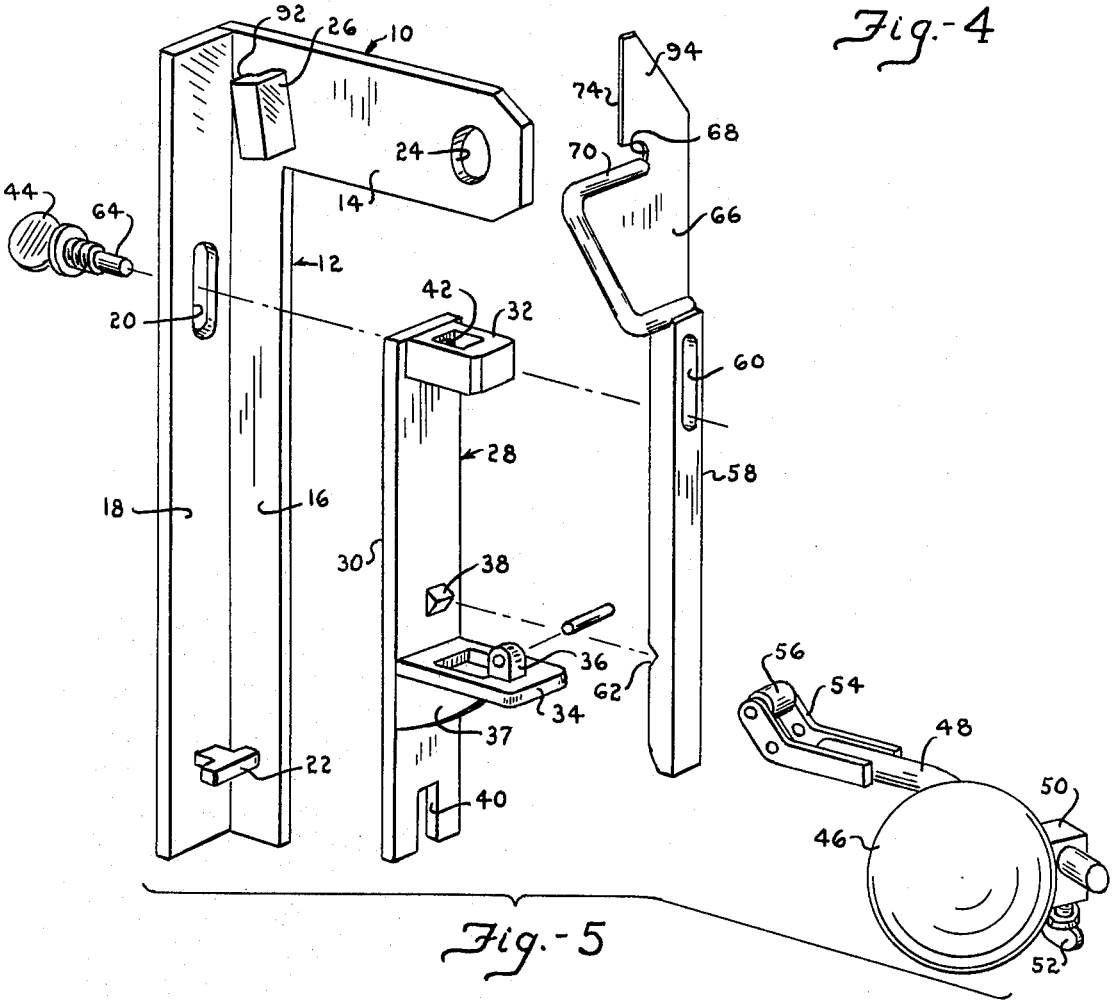
FIG. 5 is a perspective view of the flush control device showing the component parts thereof in exploded relation.
Figure 6:
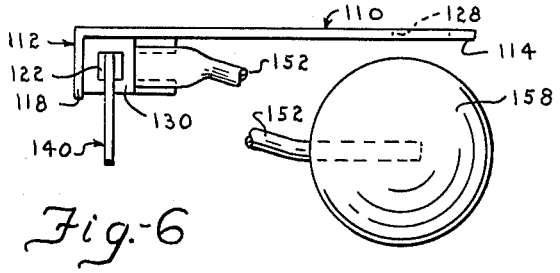
FIG. 6 is a top view of the preferred flush control device of my invention shown broken in part.
Figure 7:
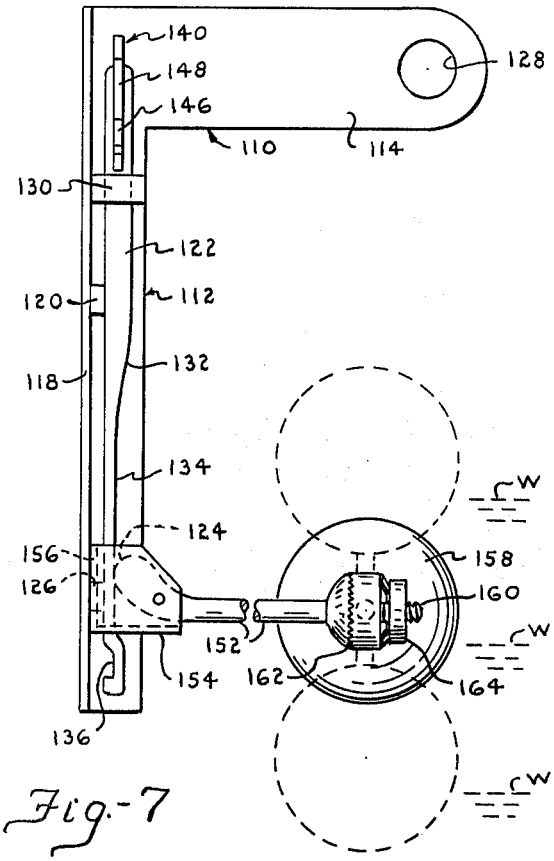
FIG. 7 is a rear view of the flush control device of my invention looking from the rear of the flush tank which is shown broken and in cross section.
Figure 8:
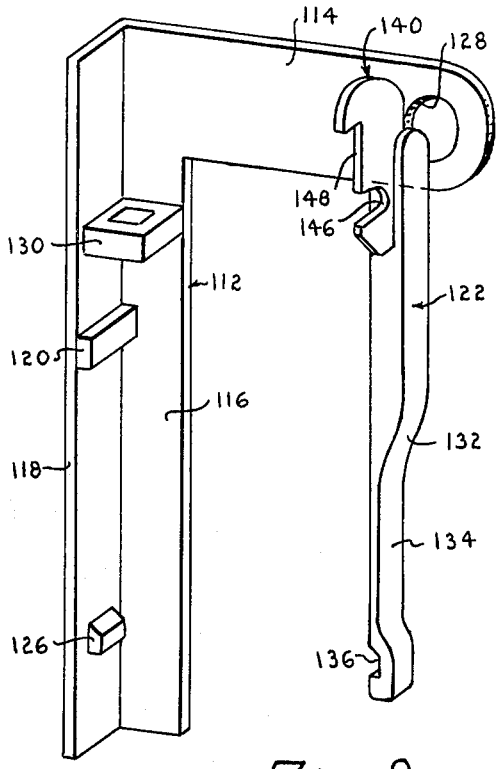
FIGS. 8 and 9 are perspective views of the preferred flush control device of my invention showing the component parts thereof in exploded relation.
Figure 9:
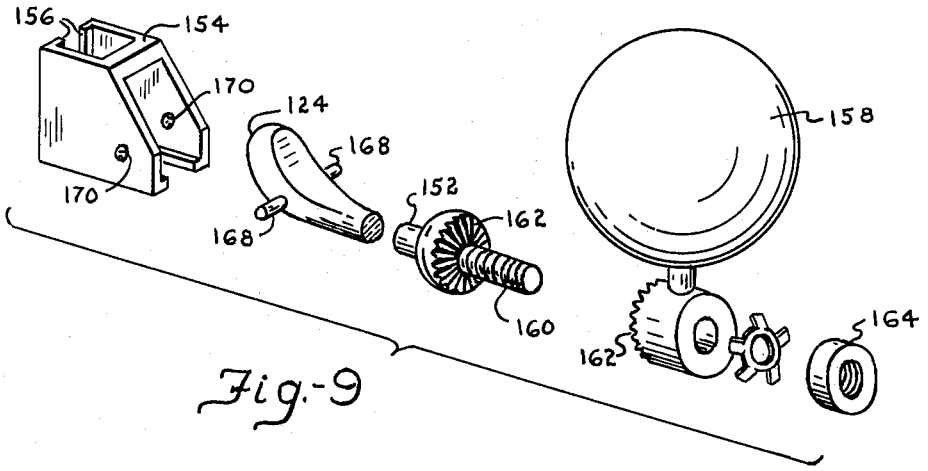

As shown in FIGS. 1 and 3, the conventional ball stopper lever 72 is connected to flush handle 76 through wall 78 of water tank 80. For the selective operation of the flush device 10 of my invention, I provide spring means 82 in the bushing assembly 84 through which lever 72 and flush handle 76 are connected to bias handle 76 away from water closet wall 78.

Lever 72 is normally seated in slot 68 in flexible member 66 because spring 82 normally biases handle 76 away from tank wall 78 and lever 72 is thereby contained in slot 68 preparatory for the short flush operation. When handle 76 is manually pushed against tank wall 78 against the bias of spring 82, lever 72 is laterally displaced on edge 70 of flexible member 66 clearing the top edge 74 of slot 68 and then upon rotation of handle 76 stopper 86 may be lifted from its seat in discharge outlet 90 for the conventional flush. Edge 74 of flexible member 66 extends upright a sufficient distance to prevent lever 72 from accidentally being displaced toward wall 78 of toilet tank 80 and thereby escaping the confines of edge 74 and slot 68.

In the operation of my invention, support member 12 is connected to water closet wall 78 at bushing assembly 84 axially supporting flush handle 76. This may conveniently be accomplished by inserting the threaded end of bushing 84 through hole 24 in horizontal arm 14 of support member 12 and connect support member 12 as well as handle 76 to water closet wall 78 by a single nut 88. My invention 10 assembled as herein described is normally ready for short flush operation since liquid waste is more frequently discharged than solid wastes. Accordingly, if the flush handle 76 is rotated, a short cycle flush is initiated. In such flushes, ball stopper lever 72 being normally positioned in slot 68 of flexible member 66, rotation of flush handle 76 and lever 72 connected thereto, operate to lift stopper 86 from its seat in discharge outlet 90. The pivotal movement of lever 72, being contained in slot 68 by the bias of spring 82, will lift rod 58 within the limits of slots 60 which will abut against shaft end 64 of thumb screw 44 as rod 58 is guided in its vertical movement by guide brackets 32 and 34. As rod 58 is lifted, flexible member 66 flexes as distal end 94 thereof moves along incline surface 92 of wedge block 26. Rod 58 is lifted by the pivot movement of lever 72 until notch 62 is aligned with detent 38 on back plate member 30 at which time detent 38 will engage notch 62 and rod 58 will thereby be prevented from dropping downward by the action of cam roll 56 bearing against the opposite side of rod member 58. Roll 56 bears against the side of rod 58 since float arm 48 is pivotally connected to lug 36 of guide bracket 34. The pressure exerted by roll 56 is a function of the weight of the water displaced by float 46 acting at a moment arm which is float arm 48. Ball stopper lever 72 is thus limited in its upward pivot movement thereby limiting the elevation of ball stopper 86 from its seat in discharge outlet 90 allowing the water to be discharged therethrough accomplishing the flushing operation with ball stopper 86 sufficiently in the way of the discharging wall so that upon release of the detent-notch engagement of rod 58, the outflowing water will pull stopper 86 to its seat in outlet 90 immediately stopping the flushing operation. Stopper 86 as mentioned will be released when the water level W in the water closet tank descends below float ball 46 of the device of my invention. The water level W thus receding, will allow float arm 48 to pivot clockwise as viewed in FIG. 2 thereby removing the pressure exerted by roll 56 against rod member 58 whereupon the flexed distal end 94 of flexible member 66 will cause the bottom end of rod 58 to spring away disengaging notch 62 from detent 38. This action removes the elevated support provided by edge 70 which prevented lever 72 and stopper 86 from descending to its seated position in discharge outlet 90 while the water level W was above float 46. As soon as the water level W descends below float 46, the locking action of detent 38 in notch 62 is released allowing the seating of stopper 86 terminating the flush with a substantial amount of water remaining in the water closet tank.

The conventional flushing operation is initiated by first pushing in handle 76 prior to the rotation movement. This action removes lever 72 from slot 68 thereby disengaging it from the flush device of my invention and allowing the action of a conventional flush. Since lever 72 will then pivot to raise ball stopper 86 to its maximum height so that it will float out of the way of the discharging water, the water contents of the tank will be completely discharged and stopper 86 will descend to its seat in the discharge outlet 90 as it floats on the water level.

It should be understood that the structure of the means by which rod member 58 is supported in its elevated position when the float cam means pivots against the rod member, may be any convenient structure. Friction alone between rod member 58 and guide members 32 and 34 will be sufficient if the lateral force provided by cam roller 56 against rod member 58 is sufficient to prevent rod member 58 from dropping while float ball 46 is buoyed up by the water level in the tank. For purposes of showing a positive stop, I illustrate a detent-notch engagement between rod member 58 and guide means 28. However, other structures may perform this function equally well such as, for example, the bottom of rod member 58 resting on a projection provided on back plate 30. It should also be understood that other types of spring means other than flexible member 66 may be used to free rod member 58 from its positive stop engagement, or for that matter no spring means at all will be necessary if upon removal on the side force on rod member 58 exerted by cam roller 56, rod member 58 will drop unaided. Though I show the resiliency of flexible member 66 reacting against wedge block 26 as aiding the disengagement of the positive stop means between guide means 28 and rod member 58, it should be understood that other type spring means can be located at any convenient position to bear against rod member 58 in order to disassociate the elements of the positive stop means.

The device 10 of my invention may also be used to control a fixed amount of water to be discharged in a flush. The flush cycle will not be determined by the user but will be pre-set by adjusting float 46 in combination with the height adjustment of rod guide assembly 28 on flange 18 as determined by the position of thumb screw 44 in slot 20. Spring 82 may be removed or made inoperable, or flush handle 76 may be conventional flush handle, so that it may not be pushed in an d stopper lever 72 will be in permanent engagement with flexible member 66. So adjusted, or if spring 82 is removed, or if device 10 is connected to a conventional flush handle, a controlled amount of water will be discharged for every flush operation regardless whether the waste flushed is liquid or solid. The amount of water flushed will be more than the short flush but less than the conventional flush. This modified use of the flush device 10 of my invention may be used in situations where it will be impractical to teach users the selective flushing feature of this invention such as when used in hotels and motels and other such places where there will be transient users.

It will be noted that I provide rod guide assembly 28 separable from support frame 12 and easily removable therefrom. This feature of my invention is particularly advantages since assembly 28 contains all the moving parts which could wear and may be economically and easily replaced without removing the entire device of my invention.

FIGS. 1 through 5 illustrate the flush control device of my invention disclosed in the original patent application. Through the flush control device 10 of my invention functions satisfactorily and accomplishes the stated objectives, several experimental models manufactured subsequent to the filling of the original application revealed that a second preferred embodiment of this invention can be made operating on the same general principle but simpler, more economical in structure and less likely to malfunction then my flush control device 10 illustrated in FIGS. 1 through 5.

Accordingly, this invention as illustrated in FIGS. 6 through 9 discloses an improved flush control device in that it is simpler in structure, more economical to manufacture in that it has less parts and is not subject to malfunction.

With reference to FIGS. 6 through 9, numeral 110 designates generally my now preferred flush control device. It comprises a support member 112 formed with a horizontally extended arm 114 and a vertically extended leg 116 depending therefrom. Leg 116 is provided with a flange 118. Flange 118 is provided with a projection 120 which extends toward rod lift member 122. Though it is not necessary to provide means for a positive stop because rod 122 may be supported in an elevated position solely by friction between rod 122 and flange 118 if the force exerted by float-operated cam end 124 is great enough, a detent 126, as an example of a positive stop means, is preferably provided on flange 118. Horizontally extended arm 114 has a hole 128 to allow mounting of the flush control device in water tank 80 in the same manner as flush control device 10 as shown in FIGS. 1 through 3.

Supported on support member 112 against flange 118 and leg 116 is guide bracket 130. Guide bracket 130 maintains rod-lift member 122 in the required position for longitudinal movement. Rod member 122 is formed with a tapered section as at 132 between the upper portion and thinned flexible lower portion 134. Notch 136 is formed in the end of lower portion 134 of rod member 122 to engage detent 126 thereby forming a means for positively locking rod member 122 in its elevated position.

Figure 2:
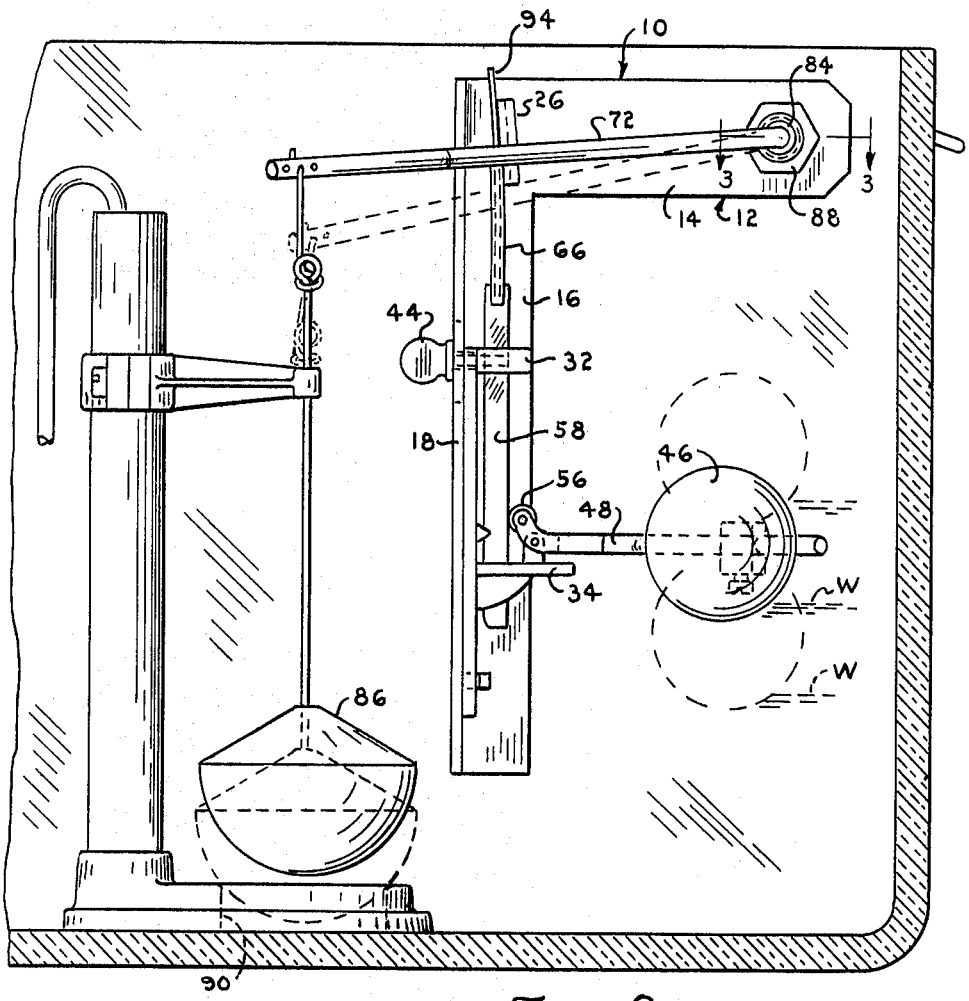
FIG. 2 is a rear view of the flush control device in the flush tank which is shown broken and in cross section.

Extending from the top of rod member 122 is lever engaging means 140 for engaging lever 72 connected to lift stopper 86 when flush control device 110 is installed in water tank 80 of FIGS. 1 and 2 in place of flush control device 10. Means 140 prevents further pivotal movement of lever 72 when rod 122 is arrested in its longitudinal movement. Means 140 which may be formed integral with or attached to rod member 122 has a horizontally disposed slot 146 for receiving lever 72 which is normally seated in slot 146. The upper edge of horizontal slot 146 terminates at 148 and that part of means 140 extends upright to form a notched side above slot 146 for cooperation with lever 72 when it is desired to use the full contents of water tank 80 shown in FIG. 2.

A float lever arm generally designated as 152 is pivotally connected to housing 154 mounted on flange 118. Housing 154 preferably has a flange 156 protruding from at least one side of housing 154 toward member 122 positioned therebetween. Flange 156 limits the pressure applied to end portion 134 of member 122 by cam end 124. Float lever arm 152 has an adjustable positioned float 158 connected to threaded distal end 160 of float arm 152 by any convenient means such as ratchet joint connection 162 and held in the desired position by any convenient means such as fastener 164 on distal end 160. The other end of arm 152 is provided with pins 168 for pivotal connection to housing 154 in holes 170. Housing 154 also serves as a lower guide means for member 122.

As shown in FIG. 3, the conventional ball stopper lever 72 is connected to flush handle 76 through wall 78 of water tank 80. For selective operation of flush device 110 of my invention, I provide spring means 82 in bushing assembly 84 through which lever 72 and flush handle 76 are connected to bias handle 76 away from water closet wall 78.

Similarly, lever 72 is normally seated in slot 146 in lever engaging means 140 because spring 82 normally biases handle 76 away from tank wall 78 and lever 72 is thereby contained in slot 146 preparatory for the short flush operation. When handle 76 is manually pushed against tank wall 78 against the bias of spring 82, lever 72 is laterally displaced from slot 146 and then upon rotation of handle 76, stopper 86 may be lifted from its seat in discharge outlet 90 for the conventional flush. Notched side 148 provided in lever engaging means 140 extending upright from slot 146 a sufficient distance to prevent lever 72 from accidentally being displaced toward wall 78 of toilet tank 80 and thereby escaping the confines of means 140.

In the operation of the preferred embodiment of my invention, support member 112 is connected to water closet wall 78 at bushing assembly 84 axially supporting flush handle 76. This may conveniently be accomplished by inserting the threaded end of bushing 84 through hole 128 in horizontal arm 114 of support member 112 and connect support member 112 as well as handle 76 to water closet wall 78 by a single nut 88 much in the same manner described above for flush control device 10. My invention 110 assembled as herein described is normally ready for short flush operation since liquid waste is more frequently discharged than solid wastes. Accordingly, if the flush handle 76 is rotated, a short cycle flush is initiated. In such flushes, ball stopper lever 72 being normally positioned in slot 146 of means 140 in my now preferred embodiment, rotation of flush handle 76 and lever 72 connected thereto, operate to lift stopper 86 from its seat in discharge outlet 90. The pivotal movement of lever 72, being contained in slot 146 by the bias of spring 82, will lift rod 122 until notch 136 is vertically aligned with detent 126, at which time detent 126 engages notch 136 and rod 122 will thereby be prevented from dropping downward by the action of cam end 124 bearing against the opposite side of rod member 122. Cam end 124 bears against the opposite side of rod 122 since float arm 152 is pivotally connected to housing 154. The pressure exerted by cam 124 is a function of the weight of the water displaced by float 158 acting at a moment arm which is float arm 152. Ball stopper lever 72 is thus limited in its upward pivot movement thereby limiting the elevation of ball stopper 86 from its seat in discharge outlet 90 allowing the water to be discharged therethrough accomplishing the flushing operation with ball stopper 86 sufficiently in the way of the discharging water so that upon release of the detent-notch 126, 136 engagement of rod 122, the outflowing water will pull ball stopper 86 to its seat in outlet 90 immediately stopping the flushing operation. Stopper 86 as mentioned will be released when the water level W in the water closet tank descends below float ball 158 of the device of my invention. The water level W thus receding, will allow float arm 152 to pivot clockwise as viewed in FIG. 7 thereby removing the pressure exerted by cam 124 against rod member 122 whereupon thin flexible portion 134 of rod 122 will spring away disengaging notch 136 from detent 126. As soon as the water level W descends below float 158, the locking action of detent 126 in notch 136 is released allowing the seating of stopper 86 thus terminating the flush with a substantial amount of water remaining in the water closet tank 80.

The conventional flushing operation is initiated by first pushing in handle 76 prior to the rotation movement. This action removes lever 72 from slot 146 thereby disengaging it from the flush device of my invention and allowing the action of a conventional flush. Since lever 72 will then pivot to raise ball stopper 86 to its maximum height so that it will float out of the way of the discharging water, the water contents of the tank will be completely discharged and stopper 86 will descend to its seat in the discharge outlet 90 as it floats on the water level.

It should be understood that the structure of the means by which rod member 122 is supported in its elevated position when the float cam means 124 pivots against rod member 122, may be any convenient structure. Friction alone between rod member 122 and flange 118 will be sufficient if the lateral force provided by cam end 124 against rod member 122 is sufficient to prevent rod member 122 from dropping while float ball 158 is buoyed up by water level W in the tank. For purposes of showing a positive stop, I illustrate a detent-notch engagement between rod member 122 and flange 118. However, other structures may perform this function equally well such as, for example, the bottom of rod member 122 resting on a projection provided on flange 118. It should also be understood that other types of spring means other than flexible member 134 may be used to free rod member 122 from its positive stop engagement, or for that matter no spring means at all will be necessary if upon removal of the side force on rod member 122 exerted by cam end 124, rod member 122 will drop unaided. Though I show the resiliency of flexible member 134 reacting on wedge block 120 as aiding the disengagement of the positive stop means between flange 118 and rod member 122, it should be understood that other type spring means can be located at any convenient position to bear against rod member 122 in order to disassociate the elements of the positive stop means.

Still, a third embodiment of my invention is illustrated in FIGS. 10 through 13 of the drawings. This embodiment of my invention which functions to control the long flush cycle, is designated generally by the numeral 210 and comprises a duplex version of the flush control device 110 illustrated in FIGS. 6 through 9. It will be noted from the comparison of FIGURES illustrating the devices 110 and 210 that the duplex flush control device 210 comprises a similar support member 212 formed with a horizontally extended arm 214 and a vertically extended leg 216 depending therefrom. Leg 216 is provided with flange 218 which is formed with lateral extensions on which are provided guide bracket 230, fulcrum projection 220 and detent 226 which perform the same functions as their counterparts of flush control device 110 of FIGS. 6 through 9. The structure a rod lift member 222 is similar to rod lift member 122 of device 110 of my invention above described having a tapered section 232, a flexible portion 234 and a notch 236 in the lower end of member 222 to engage detent 226 to lock rod member 222 in an elevated position.

Figure 10:
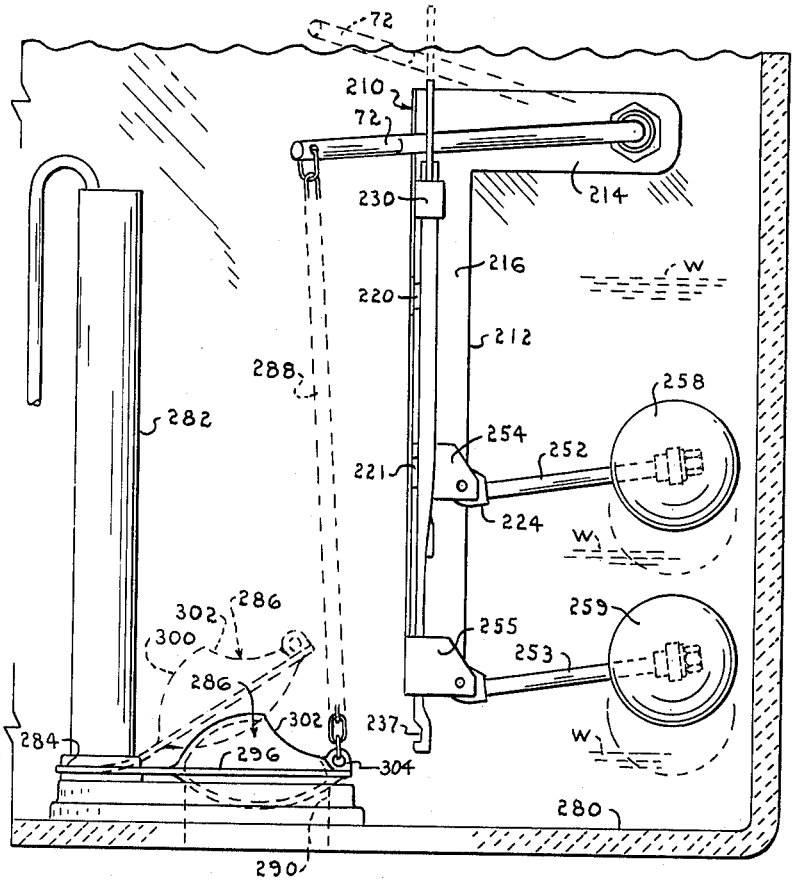
FIG. 10 is a rear view of another preferred embodiment of the flush control device in the flush tank which is shown broken and in cross section.
Figure 11:
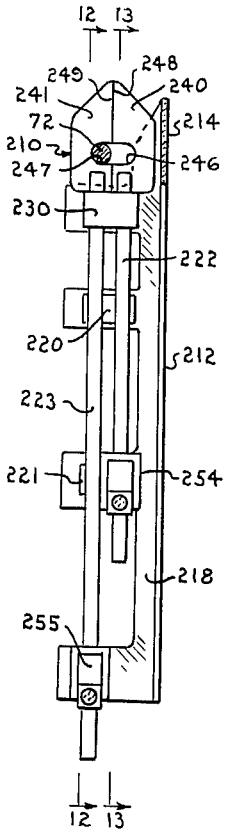
FIG. 11 is a side view of the flush control device of FIG. 10 shown partly sectioned.

Extending from the top of rod lift member 222 is lever engaging means 240 for engaging lever 72 which is connected to stopper lift link 288 when flush control device 210 is installed in water tank 280 of FIG. 10. Means 240 prevents further pivotal movement of lever 72 when rod 222 is arrested in its longitudinal movement. Means 240 which may be formed integral with or attached to rod member 222 has a horizontally disposed slot 246 for receiving lever 72 which is normally seated in slot 246 due to the bias of spring 82 (FIG. 3). Lever engaging means 240 unlike lever engaging means 140 and 66 of flush control devices 110 and 10 respectively, is formed with a straight edge 248 to which slot 246 opens.

Figure 12:
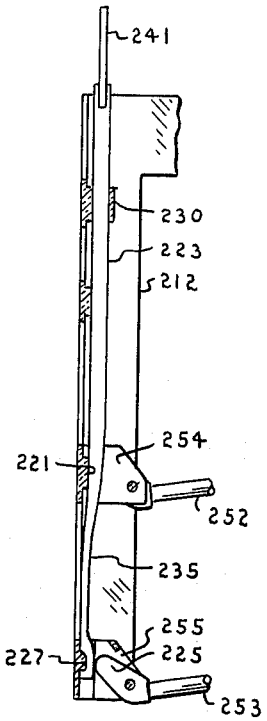
FIG. 12 is a rear view of the flush control device taken along lines 12—12 of FIG. 11.
Figure 13:
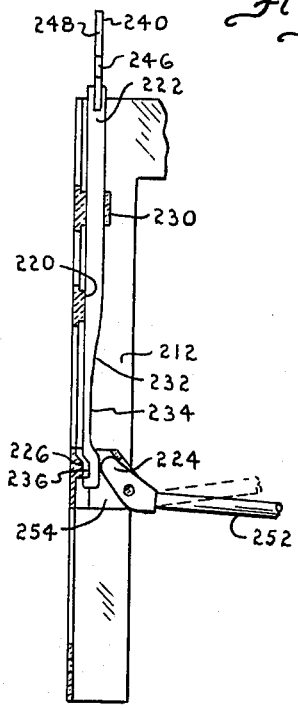
FIG. 13 is a rear view of the flush control device taken along lines 13—13 of FIG. 11.
Figure 14:
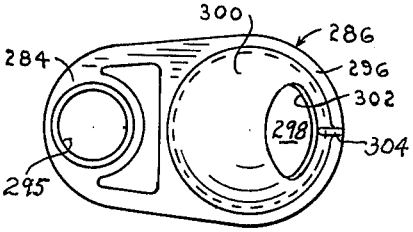
FIG. 14 is a top view of an outlet stopper.
Figure 15:
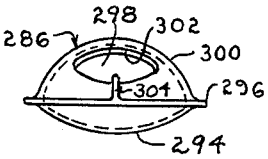
FIG. 15 is a front view of the outlet stopper of FIG. 14.

A second rod member 223 is spaced laterally adjacent to rod member 222 and is similar in structure to rod member 222 differing only in the length thereof and the facing direction of lever engaging means 241 being reversed so that slot 247 formed therein is horizontally aligned with slot 246 of means 240 when both rod lift members are in non-flushing repose. The corresponding edge 249 of lever engaging means 241 mates with and is in contiguous sliding contact with the edge 248 of means 240 of rod member 222. Due to the extended length of rod lift member 223, flange 218, as shown in FIG. 12, is provided with a second housing 255 and detent 227 for guiding and engaging respectively the notch 237 provided in the lower portion 235 of rod member 223. Projection 221 is provided on flange 218 extending toward rod lift member 223 to serve as a flexing fulcrum therefor. The purpose of the duplex arrangement of rod members 222 and 223 is to provide control for both the short and long flush. This embodiment 210 of my invention is particularly applicable for an outlet stopper 286 which does not float. Outlet stopper 286 is connected to the base of the water overflow pipe 282 and is formed from flexible material to allow pivoting movement when lifted by link 288 so that upon release, stopper 286 will pivotedly fall to seat in outlet 290. Accordingly, the function of duplex rod lift member 223 is to retain lever 72 in the elevated position so that a long flush may be accomplished with outlet stopper 286 which does not float. This embodiment of my invention utilizes float operated cam 224 for locking rod member 222 in the elevated position until water level W recedes below float 258 at which point cam 224 releases rod member 222 allowing it, together with lever 72, to fall, dropping stopper 286 to seat in outlet 290 thereby accomplishing the short flush operation. When it is desired to perform the long flush whereby the entire or controlled amount of the water content of toilet tank 280 is discharged, flush handle 76 (FIG. 3) is pushed toward the tank against the bias of spring 82 laterally moving stopper lift lever 72 in horizonal slot 247 (FIG. 11) of lift means 241 of rod member 223 thereby lifting rod member 223 until its notch 237 in the lower end thereof engages detent 227 and retained in locking engagement by float operated cam 290 and maintaining stopper 286 in the raised position allowing the water to be discharged from tank until water level W in the tank recedes below float 259 at which time cam member 225 will release rod member 223 from the detent-notch engagement allowing the tapered end 235 of rod member 223 to disengage by springing away from the detent. This embodiment of my invention has the added advantage of not only controlling or regulating the amount of water to be used for the short flush, but also the amount of water to be used for along flush. This is accomplished by adjusting the ball floats 258 and 259 on their respective cam lever arms 252 and 253. Since the amount of water to be used in the respective flushes may be controlled very accurately by the use of my invention, particularly the embodiment of FIGS. 10 through 13, I provide in conjunction with my invention an outlet stopper 286 which is new and novel and operates to open and close outlet 290 quickly and firmly. FIGS. 14 and 15 show outlet stopper 286 of my invention which is to be used with the duplex embodiment of my flush control device. It comprises a stopper body having a shallow dished bottom 294 circumscribed by a circumferential rim 296 which projects rearwardly as a flexible flap 284 provided with a circular opening 295 for anchoring to the base of discharge pipe 282 by means which it is hingedly connected to outlet 290 for pivoting out of the outlet seat for the flushing operation. The top 300 of stopper 286 is domed to provide an interior hollow 298 having an opening 302 in the forward quadrant thereof adjacent the lift link 304 so that when pivotedly raised, the opening 302 in the domed part thereof is at the zenith position so that hollow 298 remains filled with water. The purpose of this construction is to provide the stopper 286 with sufficient weight to close stopper 286 in outlet 290 with sufficient force to effect a tight seal. This construction also allows the bottom 294 of the stopper to be narrowly dished so that upon lifting the stopper, the flush commences rapidly and forcefully.

While I have described my embodiments of my invention, it will be understood by those skilled in the art that various other alternatives and combinations of my invention can be practiced and I intend only to be bound by the scope of the appended claims.

I claim:

1. A flush control device for a water tank comprising a stopper seated in an outlet liftable therefrom to allow the water to discharge through the outlet and wherein said lifting of said stopper is accomplished by a lever connected to said stopper by a link and lever being pivotable by a handle exterior of the tank, guide means supported in said tank;

a rod member longitudinally movable in said guide means;

a float lever arm pivotally supported to laterally bear against said rod member to arrest said longitudinal movement of said rod member; and means on said rod member for engaging said lever connected to lift said stopper, said means preventing pivotal movement of said lever when said rod member is arrested in its longitudinal movement.

2. A flush control device for a water tank comprising a stopper seated in an outlet liftable therefrom to allow the water to discharge through the outlet and wherein said lifting of said stopper is accomplished by a lever connected to said stopper by a link, said liner being pivotable by a handle exterior of the tank;

guide means;

a rod member vertically movable in said guide means;

float means supported for pivotal movement against said rod member;

means for arresting the vertical movement of said rod member when said float means moves against said rod member;

means on said rod member for engaging said lever, said means limiting the pivotal movement of said lever when said rod member is arrested in its vertical movement; and spring means for disengaging said lever and said means on said rod member.

3. The flush device of claim 2 wherein said float means is further characterized as being pivotally supported on said guide means at a position intermediate the maximum and minimum water level in said tank.

4. The flush device of claim 2 wherein said float means is further characterized as being pivotally supported on said guide means at a position intermediate the maximum and minimum water lever in said tank.

5. The flush device of claim 4 wherein said means for arresting the vertical movement of said rod member is further characterized as being a projection-platform engagement.

6. The flush device of claim 5 wherin said means for arresting the vertical movement of said rod member is further characterized as being a notch-detent engagement.

7. The flush device of claim 5 wherein said means on said rod member for engaging said lever is further characterized as being a slotted recess for receiving said lever.

8. A flush control device for a water tank comprising stopper seated in an outlet liftable therefrom to allow the water to discharge through the outlet and wherein said lifting of said stopper is accomplished by a lever connected to said stopper by a link said lever being pivotable by a handle exterior of the tank, support means in said tank;

guide means on said support means;

a rod member vertically movable in said guide means;

float means supported on said guide means for pivotal movement against said rod member;

means on said rod member for arresting the upward vertical movement of said rod member;

means on said rod member for arresting the downward vertical movement of said rod member when said float means moves against said rod member;

means on said rod member for engaging said lever, said means limiting the pivotal movement of said lever when said rod member is arrested in its vertical movement; and spring means between said support means and the handle for urging said lever and said means on said rod member in connecting engagement, said spring means being depressable by said handle to disengage said lever from said means on said rod member;

9. The flush device of claim 8 wherein said guide means is further characterized as being removably connected to said support means.

10. A flush control device for a water tank comprising:

support means for connection to said tank;

guide means on said support means;

a rod member vertically movable in said guide means;

an arm member pivotally supported on said guide means, a float connected to one end of said arm member and a roll member at the other end of said arm member pivotally movable against said rod member;

means on said rod member and said guide means for arresting the vertical movement of said rod member when said roll member of said arm moves against said rod member;

said rod member provided with means to engage said lever in said water tank which lifts said stopper, limiting the pivotal movement of said lever;

said means provided on said rod member for engaging said lever being manually disengageable; and spring means on said support means acting against said rod member to separate said means on said rod member and said means on said guide means when said roll member on said arm pivotally moves away from said rod member.

11. The flush device of claim 10 wherein said rod member vertically movable on said guide is further characterized as being constrained in said guide means for limited upward movement.

12. A flush control device to limit the amount of water discharged from a water tank having a stopper seated in an outlet and liftable therefrom to allow said water to discharge through said outlet and wherein said lifting is accomplished by a lever connected to said stopper by a link said lever being pivotable by a handle exterior of said tank;

a support adapted to be mounted in said tank;

guide means on said support;

a member for longitudinal movement in said guide means;

a float lever arm pivotally supported to bear against said member to arrest said longitudinal movement of said member; and a means on said member for engaging said lever connected to lift said stopper, said means stopping pivotal movement of said lever when said member is arrested in its longitudinal movement.

13. The flush control device of claim 12 wherein said lever is further characterized as being disengageable from said means on said member.

14. The flush control device of claim 13 wherein at least a portion of said member mounted for longitudinal movement in said guide means is further characterized as being flexible.

15. The flush control device of claim 14 wherein said support is further characterized as having a detent on said support and wherein said member is further characterized as having a notch for mating engagement with said detent to positively arrest said longitudinal movement of said member when said float lever arm bears against said member.

16. The flush control device of claim 15 wherein said support is further characterized as having means which projects outwardly to bear against said member when said member is in an arrested position to assure disengagement of said notch with said detent when said float lever are releases said member.

17. The flush control device of claim 13 wherein said float lever arm support is further characterized as having means to limit the pressure applied to said member by said float lever arm.

18. The flush control device of claim 17 wherein said means to limit said pressure against said member is further characterized as being a projection on said support adjacent to at least one side of said member so that said float lever arm bears against said member and said projection.

19. The flush control device of claim 12 wherein said float is further characterized as being adjustable on said lever arm to change the quantity of said water to be discharged.

20. A flush control device to limit the amount of water discharged from a water tank having a stopper seated in an outlet and liftable therefrom to allow said water to discharge through said outlet and wherein said lifting is accomplished by a lever connected to and pivotable by a handle exterior of said tank, comprising:

a support adapted to be mounted in said tank;

guide means on said support;

a member mounted for longitudinal movement in said guide means;

a float lever arm pivotally supported to bear against said member to arrest said longitudinal movement of said member;

means on said member for engaging said lever connected to lift said stopper, said means stopping pivotal movement of said lever when said member is arrested in its longitudinal movement;

a second member mounted for longitudinal movement in said guide means;

a second float lever arm pivotedly supported to bear against said second member to arrest said longitudinal movement of said second member; and means on said second member for engaging said lever connected to lift said stopper, said means stopping pivotal movement of said lever when said second member is arrested in its longitudinal movement.

21. The flush control device of claim 20 wheren said means on said first member and said means on said second member for engaging said lever are further characterized as being aligned notches.

22. The flush control device of claim 21 wherein said lever is further characterized as being movable to engage either of the notches of said first means and said second means on said members.

23. The flush control device of claim 20 wherein said support is further characterized as having detents, and wherein said first and second members are further characterized as having notches for mating engagement with said detents to positively arrest said longitudinal movements of said first and second members when said first and second float lever arms bear against said first and second members respectively.

24. The flush control device of claim 23 wherein said first and second float lever arms are further characterized as being pivotedly supported at different elevations.

* * * * *